United States Patent [19]

Shibuya et al.

[11] Patent Number: 4,502,854

[45] Date of Patent: Mar. 5, 1985

[54] VANE COMPRESSOR HAVING REARWARDLY LOCATED SUCTION CONNECTOR AND DISCHARGE CONNECTOR

[75] Inventors: Tsunenori Shibuya; Yutaka Ishizuka; Teruo Nakamura, all of Konan, Japan

[73] Assignee: Diesel Kiki Co., Ltd., Saitama, Japan

[21] Appl. No.: 477,015

[22] Filed: Mar. 21, 1983

[30] Foreign Application Priority Data

Mar. 23, 1982 [JP] Japan ..... 57-45856

[51] Int. Cl.[3] ..... F04C 18/00; F04C 29/00

[52] U.S. Cl. ..... 418/15; 418/104; 418/133

[58] Field of Search ..... 418/15, 86, 133, 259–270, 418/104

[56] References Cited

U.S. PATENT DOCUMENTS

| | | | |
|---|---|---|---|
| 2,634,904 | 4/1953 | Clerc | 418/265 |
| 2,942,774 | 6/1960 | Blackman | 418/86 |
| 3,404,634 | 10/1968 | Connelly | 418/133 |
| 3,711,225 | 1/1973 | Kolbe et al. | 418/133 |
| 3,964,844 | 6/1976 | Whitmore et al. | 418/133 |

*Primary Examiner*—John J. Vrablik

*Attorney, Agent, or Firm*—Frishauf, Holtz, Goodman & Woodward

[57] ABSTRACT

A vane compressor has a suction connector and a discharge connector arranged at a rear portion thereof. A rear suction chamber is formed at a rear side of the rear side block and communicates with pump working chambers. A passage means directly communicates the above rear suction chamber with an annular front suction chamber formed in the front head in a manner surrounding a sealing chamber accommodating a shaft-seal means.

5 Claims, 6 Drawing Figures

VANE COMPRESSOR HAVING REARWARDLY LOCATED SUCTION CONNECTOR AND DISCHARGE CONNECTOR

BACKGROUND OF THE INVENTION

This invention relates to refrigerant compressors forming part of air conditioning systems for vehicles, and more particularly to a vane compressor which has a suction connector and a discharge connector arranged at a rear portion thereof.

Vane compressors are widely used in air conditioning systems for vehicles for compressing the refrigerant, by virtue of their structural simplicity and high adaptability to high speed operation. A typical vane compressor of this kind is generally constructed such that a front head is secured to a front side block which forms a pump housing in cooperation with a cam ring and a rear side block, the front side block and the front head being penetrated by a drive shaft, and the front head is formed therein with a sealing chamber in which a seal means is accommodated to seal the drive shaft against the front head. The front head is further formed therein with an annular suction chamber which also serves to cool the seal means in the sealing chamber, which is heated by rotation of the drive shaft. To this end, a suction port, through which refrigerant is introduced into the suction chamber, is formed in the front head.

In many vehicles in which such vane compressors are to be installed, a pump for power steering of the vehicle and/or a generator is placed at a front side of the compressor, providing difficulties in securing a sufficient space for accommodating a suction refrigerant hose connected to the suction connector having a suction port formed therethrough.

To avoid such difficulties, it has conventionally been proposed to arrange the suction connector and the discharge connector at a rear portion of the compressor. According to an example of such arrangement, a rear suction chamber is provided in addition to the aforementioned annular suction chamber on the front side, which is arranged at a rear side of the rear side block, whereby suction refrigerant is introduced into the rear suction chamber through the suction port in the rearwardly arranged suction connector, and then is sucked into pump working chambers defined within the pump housing, through rear pump inlets formed through the rear side block. However, this arrangement is devoid of means for cooling the aforementioned sealing chamber heated by the hot seal means.

In order to cool the sealing chamber, an arrangement has been proposed, in which all refrigerant introduced through the rearwardly located suction port is guided into the annular suction chamber on the front side, by way of a passage. However, according to this alternative arrangement, all the suction refrigerant travels through the above passage which inevitably extends through the ambience of hot discharge refrigerant, so that the suction refrigerant is heated and swelled as it travels through the passage, resulting in degradated volumetric efficiency of the refrigerant. Further, the discharge refrigerant has an increased temperature to cause a drop in the refrigerating efficiency. In addition, the travelling distance of suction refrigerant from the suction port to pump working chambers is large, spoiling the suction efficiency.

SUMMARY OF THE INVENTION

It is the object of the invention to provide a vane compressor which has a suction connector and a discharge connector both located at a rear portion thereof, and is constructed such that part of the suction refrigerant is guided into the suction chamber on the front side for cooling the sealing chamber, thereby eliminating the difficulties in provision of a sufficient space for the vehicle parts, the suction refrigerant hose, etc., ensuring sufficient cooling of the shaft-seal means, and minimizing drops in the volumetric efficiency, the refrigerating efficiency and the suction efficiency.

According to the invention, the suction connector and the discharge connector are arranged at a rear portion of the compressor. A rear suction chamber is formed at a rear side of the rear side block forming the pump housing in cooperation with the cam ring and the front side block, and communicates with pump working chambers on the suction stroke, defined within the pump housing, through rear pump inlets formed through the rear side block. A passage means is provided which directly communicates the above rear suction chamber with an annular front suction chamber which is formed around the sealing chamber in the front head and communicates with the pump working chambers through front pump inlets formed through the front side block.

Preferably, at least two communication passages are formed in the front head, which communicate the front suction chamber with the sealing chamber.

The above and other objects, features and advantages of the invention will be more apparent from the ensuing detailed description taken in conjunction with the accompanying drawings.

BRIEF DESCRIPTION OF THE DRAWINGS

FIG. 1 illustrates another conventional vane compressor of the diametrically symmetrical double chamber type;

DETAILED DESCRIPTION

Figure 1:
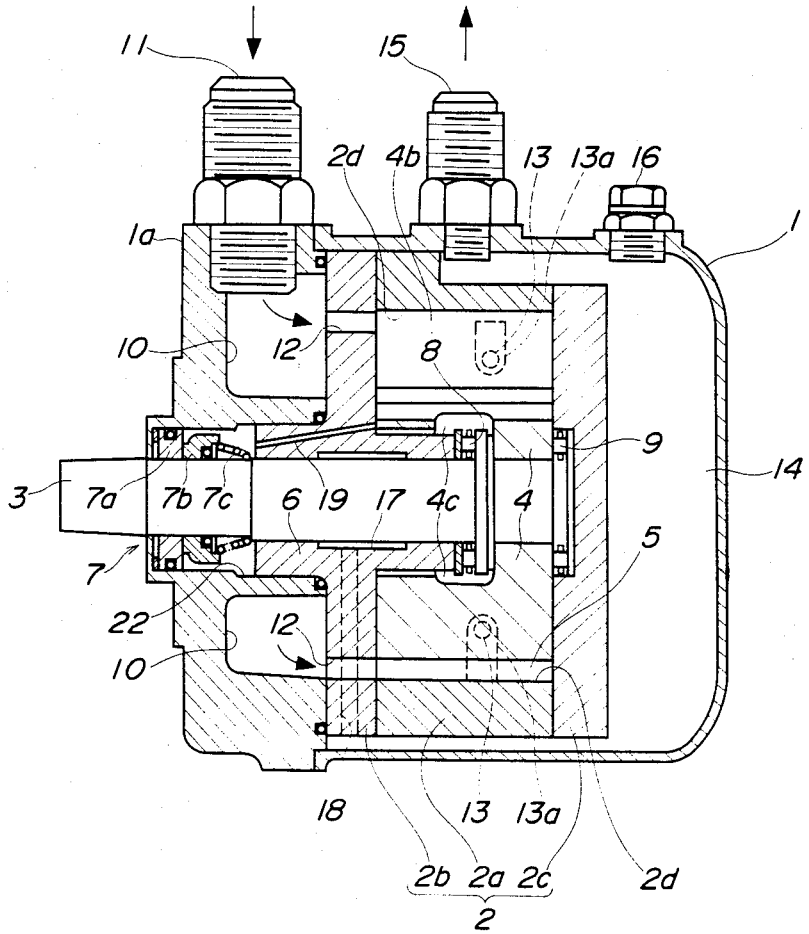
FIG. 1 PRIOR ART
FIG. 1 is a vertical sectional view of a conventional vane compressor of the diametrically symmetrical double chamber type, taken along a line extending through the pump inlets and the drive shaft.

Referring to FIG. 1, there is illustrated a conventional vane compressor of the diametrically symmetrical double chamber type. Accommodated in a cylindrical casing 1 is a pump housing 2 which is formed by a cam ring 2*a* having an oblong section, and front and rear side blocks 2*b* and 2*c* secured to the opposite ends of the cam ring 2*a*. A front head 1*a* is secured to the front side block 2*b* in a manner hermetically closing the front open end of the casing 1. A cylindrical rotor 4 is accommodated within the pump housing 2, which is rigidly fitted on a rear end portion of a drive shaft 3, and carries a plurality of plate-like vanes 4b radially slidably fitted in axial slits 4a formed in the outer peripheral surface of the rotor. As the rotor 4 rotates, pump working chambers 5 are defined by adjacent vanes 4b, the outer peripheral surface of the rotor 4, and an endless camming inner peripheral surface 2d of the cam ring 2a. The drive shaft 3 is journalled by an integral bearing portion 6 of the front side block 2b and extends through a sealing chamber 22 formed in the front head 1a in a gastight manner. The drive shaft 3 and the rotor 4 are supported in thrust-applying directions by the front side block 2b and the rear side block 2c by means of thrust bearings 8 and 9. An annular front suction chamber 10 is formed in the front head 1a in a manner surrounding the sealing chamber 22, and communicates with a suction port formed through a suction connector 11 mounted in an upper portion of the front head 1a, and also with pump working chambers 5 on the suction stroke, through front pump inlets 12 formed through the front side block 2b. The pump working chambers 5 on the discharge stroke communicate with a discharge pressure chamber 14 defined at a rear side of the pump housing 2, by way of pump outlets 13 opening in the chambers 5, discharge valves 13a, and gaps between the outer peripheral wall of the pump housing 2 and the inner wall of the casing 1. The discharge pressure chamber 14 communicates with a suction port formed through a discharge connector 15 mounted in an upper wall of the casing 1.

The lubricating oil feeding system of the compressor includes a lubricating oil supply port 16 mounted in a rear portion of the upper wall of the casing 1, a lubricating oil feeding passage 18 communicating a gap between a lower wall of the pump housing 2 and the casing 1 with an oil groove 17 formed in the bearing portion 16 of the front side block 2b, and another lubricating oil passage 19 communicating a back pressure chamber 4c formed in the rotor 4 with the sealing chamber 22 in the front head 1a. Lubricating oil stored at the bottom of the casing 1 is forced by the discharge pressure in the discharge pressure chamber 14 to be guided through the lubricating oil feeding passage 18 into the oil groove 17 in the bearing portion 6 to lubricate the same portion, and then further guided through a clearance between the rotary shaft 3 and the bearing portion 6 into the back pressure chamber 4c in the rotor 4 to lubricate the sliding portions of the vanes 4b, and part of the lubricating oil in the back pressure chamber 4c is guided through the lubricating oil feeding passage 19 into the sealing chamber to lubricate seal means 7 accommodated therein.

The seal means 7 in the sealing chamber 22 is interposed between the front head 1a and the drive shaft 3 to seal the clearance therebetween. The seal means 7 comprises a seal sheet 7a formed of a metal material and secured to the front head 1a to seal the front head side, a main body 7b formed of a carbonic material and disposed for rotation in unison with the drive shaft 3 to seal the drive shaft side, and a spring 7c urging the main body 7b against the seal sheet 7a to seal the clearance between the seal sheet and the main body 7b.

In the vane compressor constructed as above, when the rotor 4 rotates in unison with the drive shaft 3 drivingly connected to an engine, not shown, in a vehicle or the like, the vanes 4b revolve while radially movingly sliding on the endless camming inner peripheral surface 2d of the cam ring 2a due to centrifugal force so that refrigerant is sucked into pump working chambers 5 on the suction stroke, through the suction port in the suction connector 15 and the front suction chamber 10 and the front pump inlets 12 in the mentioned order, and compressed in the pump working chambers 5 on the compression stroke, and discharged from the pump working chambers 5 on the suction stroke into the discharge pressure chamber 14 through the pump outlets 13 and the discharge valves 13a. The above cycle is repeatedly carried out, and the discharge refrigerant is temporarily stored in the discharge pressure chamber 14, and then discharged into the refrigerating circuit of the air conditioning system, through the discharge port in the discharge connector 15.

Figure 1A:
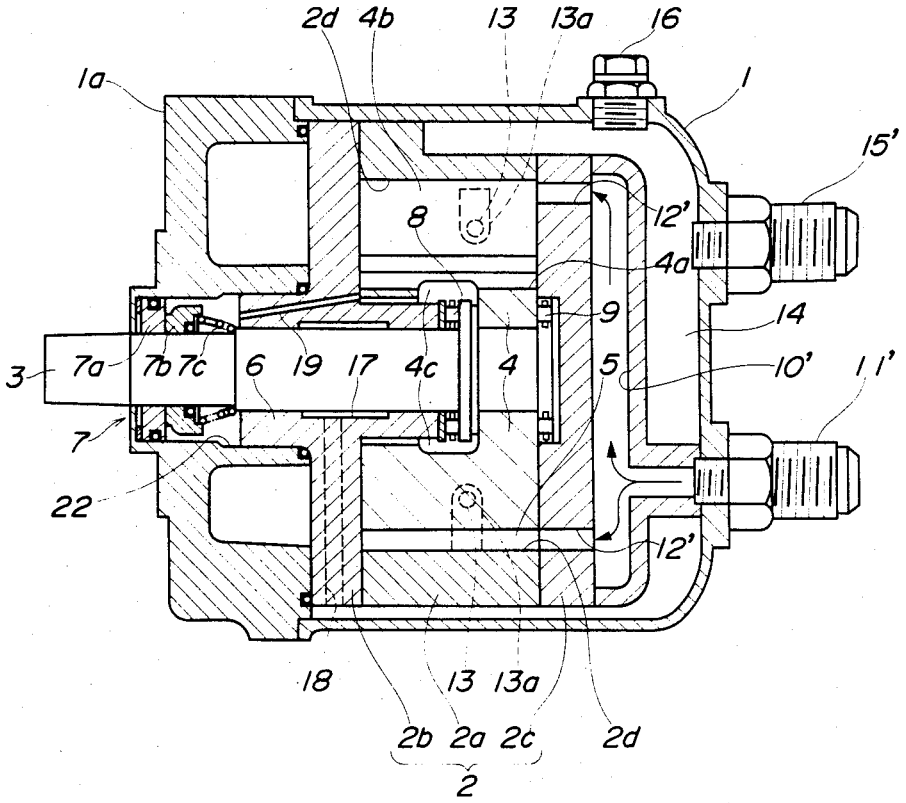
FIG. 1A PRIOR ART

The aforementioned seal means 7 generates a great deal of heat due to the sliding friction between the stationary seal sheet 7a and the rotating main body 7b. To cool the hot seal means 7, the front suction chamber 10 is shaped in the form of an annulus disposed around the sealing chamber 22, as previously noted. This front suction chamber 10 is supplied with refrigerant having temperature lower than the atmospheric temperature at most. Accordingly, the suction connector 11 formed with the suction port is provided on the front side of the compressor. This causes spacewise interference of the suction refrigerant hose with the power steering pump and/or the generator, installed in the vehicle. A conventionally proposed arrangement for avoiding such disadvantage wherein the suction and discharge connectors are arranged on the rear side of the compressor dispenses with the front suction chamber 10 and the front pump inlets 12 as shown in FIG. 1. That is, according to such proposed arrangement, as illustrated in FIG. 1A, a suction connector 11' and a discharge connector 15' are arranged on the rear end surface of the casing 1, and a rear suction chamber 10' is formed adjacent the rear side block 2c, which communicates with the suction port in the suction connector 11' and also with pump working chambers 5 on the suction stroke through rear pump inlets 12' formed through the rear side block 2c. With such arrangement, refrigerant is guided through the suction port in the suction connector 11' into the rear suction chamber 10' and sucked into pump working chambers 5 through the rear pump inlets 12', as indicated by the two arrows. The refrigerant in the pump working chambers 5 is compressed and discharged into the discharge pressure chamber 14 through the pump outlets 13 and the discharge valves 13a, and then discharged into the refrigerant circuit outside the compressor. However, this arrangement is devoid of means for cooling the hot sealing chamber 22, providing the possibility of overheating of the seal means 7.

According to another conventionally proposed arrangement, the suction connector and the discharge connector are arranged on the rear side of the compressor, e.g. on the rear end surface of the casing 1, and all suction refrigerant introduced through the suction port is guided into the front suction chamber 10 through a specially provided passage, not shown, to cool the sealing chamber 7, and then compressed and discharged as in the aforementioned arrangement. However, according to this further proposed arrangement, all the suction refrigerant travels through the specially provided passage which is disposed in the ambience of hot compressed and discharged refrigerant, resulting in degradated volumetric efficiency, refrigerating efficiency and suction efficiency of the refrigerant, as previously mentioned.

Figure 2:
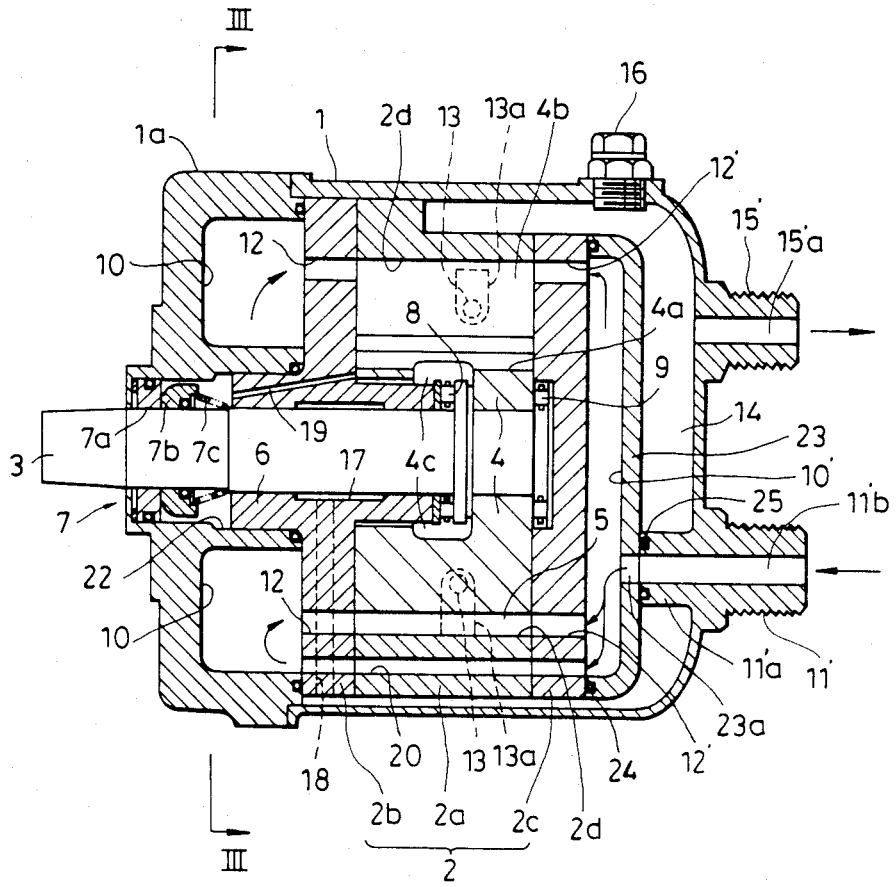
FIG. 2 is a vertical sectional view of a vane compressor of the diametrically symmetrical double chamber type according to the present invention, taken along a line extending through the pump inlets and the drive shaft.
Figure 3:
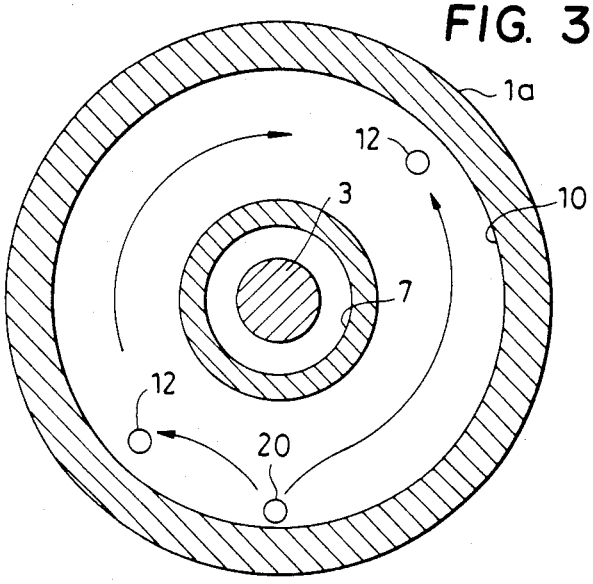
FIG. 3 is a sectional view taken along line III—III in FIG. 2.

FIGS. 2 and 3 illustrate a vane compressor according to one embodiment of the present invention, wherein parts and elements corresponding to those in FIG. 1 are designated by identical reference numerals. A suction connector 11' and a discharge connector 15' are arranged on the rear side of the compressor, i.e. formed on the rear end surface of the casing 1. A generally dished member 23 has its peripheral edge secured to the rear end surface of the rear side block 2c in an airtight abutting manner by means of suitable joining means, not shown, and with an 0-ring 24 interposed between the peripheral edge and the rear side block 2c, defining a rear suction chamber 10' between the member 23 and the rear side block 2c. The suction connector 11' has an integral inward extension 11'a abutting against the dished member 23 via an 0-ring 25 interposed therebetween such that the rear suction chamber 10' communicates with the refrigerating circuit, not shown, through a through hole 23a formed through the member 23 and a suction port 11'b in the suction connector 11', aligned with the through hole 23a. Further, the rear suction chamber 10' communicates with pump working chambers 5 on the suction stroke through rear pump inlets 12' formed through the rear side block 2c.

In a manner identical with the arrangement in FIG. 1, an annular front suction chamber 10 is formed around a sealing chamber 22 in the front head 1a and communicates with the pump working chambers 5 on the suction stroke through front pump inlets 12 formed through the front side block 2b. The rear suction chamber 10' and the front suction chamber 10 directly communicate with each other by means of a suction passage 20. In the illustrated embodiment, this suction passage 20 extends through the rear side block 2c, the peripheral wall of the cam ring 2a and the front side block 2b. Alternatively of such passage 20, a separate pipe may be used in a manner extending along the outer periphery of the pump housing 2. A discharge pressure chamber 14 is defined between the pump housing and the dished member 23, and the casing 1, and in which opens a discharge port 15'a in the discharge connector 15'.

The other parts and elements than those described above are substantially identical in construction and arrangement with those in FIG. 1, description of which is therefore omitted.

With the above described arrangement, when the rotor 4 rotates in unison with the drive shaft 3, the vanes 4b revolve while radially movingly sliding on the camming peripheral surface 2d of the cam ring 2a so that refrigerant is introduced into the rear suction chamber 10' through the suction port 11'b of the suction connector 11' and the through hole 23a of the dished member 23 and sucked into pump working chambers 5 on the suction stroke through the rear pump inlets 12'. At the same time, part of the suction refrigerant in the rear suction chamber 10' is guided into the front suction chamber 10 through the suction passage 20. The refrigerant guided into the front suction chamber 10 is swirled around the sealing chamber 22 as shown in FIG. 3, to cool the same chamber, and then sucked into the pump working chambers 5 on the suction stroke through the front pump inlets 12. The refrigerant sucked into the pump working chambers 5 is compressed in the chambers 5 on the compression stroke and discharged in the chambers 5 on the discharge stroke into the discharge pressure chamber 14 through the pump outlets 13 and the discharge valves 13a. The above cycle is repeated and the compressed refrigerant is temporarily stored in the discharge pressure chamber 14 and supplied into the refrigerating circuit through the discharge port 15'a in the discharge connector 15'.

Figure 4:
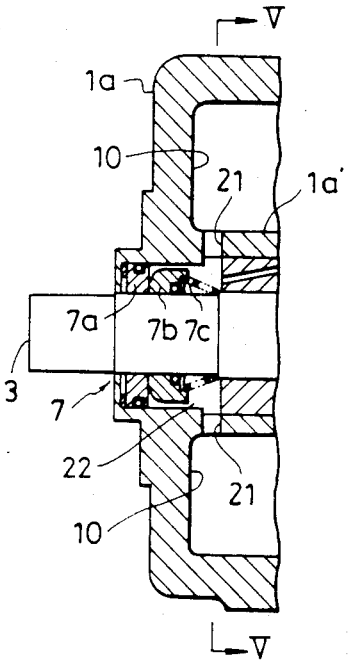
FIG. 4 is a vertical sectional view illustrating essential part of a modification of the present invention.
Figure 5:
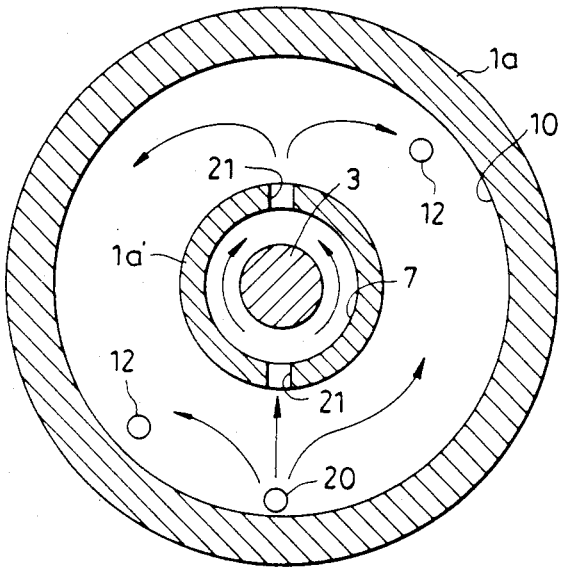
FIG. 5 is a sectional view taken along line V—V in FIG. 4.

FIGS. 4 and 5 illustrate a modification of the arrangement of FIGS. 2 and 3. To cool the seal means 7 to a further extent, two through holes 21 are formed through an annular partition wall 1a' of the front head la to communicate the front suction chamber 10 with the sealing chamber 22. Preferably, the two holes 21 are arranged in a fashion diametrically symmetrical with respect to the sealing chamber 22. With this arrangement, part of refrigerant introduced into the front suction chamber 10 through the suction passage 20 is introduced into the sealing chamber 22 to directly cool the seal means from inside, in addition to cooling same from outside. The number of the through holes 21 is not limited to two, but may be selected at any other suitable number.

As set forth above, according to the invention, the arrangement of the suction connector and the discharge connector on the rear side of the compressor enables securing a sufficient space for accommodating the power steering pump and/or the generator, to greatly facilitate the operation of connecting the suction and discharge refrigerant hoses to the suction and discharge connectors. Further, the provision of the passage means for guiding part of the suction refrigerant to the front suction chamber only in a quantity required for cooling of the sealing chamber ensures adequate cooling of the seal means 7 without spoiling the volumetric efficiency, refrigerating efficiency and suction efficiency of refrigerant.

Obviously many modifications and variations of the present invention are possible in light of the above disclosure. It is therefore to be understood that within the scope of the appended claims the invention may be practiced otherwise than as specifically described.

What is claimed is:

1. In a vane compressor including a cam ring having an endless camming inner peripheral surface, opposite ends and a peripheral wall; front and rear side blocks secured to said opposite ends of said cam ring and defining a pump housing in cooperation with said cam ring, said pump housing having at least one pump inlet and at least one pump outlet; a cylindrical rotor accommodated within said pump housing and having an outer peripheral surface thereof formed with a plurality of slits; a plurality of vanes radially slidably fitted in said slits of said rotor, adjacent ones of said vanes cooperating with said pump housing and said rotor to define therebetween pump working chambers communicating with said pump inlet or said pump outlet; a front head secured to said front side block, said front head having a sealing chamber formed therein and an annular front suction chamber formed around said sealing chamber and communicating with said pump working chambers on suction strokes thereof through said pump inlet; a drive shaft extending through said sealing chamber and said front side block and having an end portion thereof supporting said rotor for rotation in unison therewith; seal means accommodated in said sealing chamber for sealing the clearance between said drive shaft and said front head;

the improvement comprising:

at least one front pump inlet formed through said front side block and at least one rear pump inlet formed through said rear side block, said front pump inlet and said rear pump inlet forming said pump inlet, said front suction chamber communicating with said front pump inlet;

a discharge pressure chamber communicating with said at least one pump outlet;

a partition member defining a rear suction chamber between said partition member and a rear side of said rear side block, said suction chamber communicating with said pump working chambers on suction strokes thereof through said rear pump inlet and with said suction port; and passage means comprising a passage extending through said rear side block, said peripheral wall of said cam ring and said front side block and directly communicating said rear suction chamber with said front suction chamber, wherein a suction connector and a discharge connector are arranged at a rear portion of said compressor, said suction connector having a suction port formed therethrough and communicating with said rear suction chamber, and said discharge connector having a discharge port formed therethrough for communication with said discharge pressure chamber.

2. A vane compressor as claimed in claim 1, including a casing having a rear side surface, said casing enclosing said cam ring and said rear side block and defining therein said discharge pressure chamber in cooperation therewith, and wherein said suction connector and said discharge connector are arranged on said rear side surface of said casing.

3. A vane compressor as claimed in claim 1, wherein said partition member comprises a generally dished member having a peripheral edge thereof secured to said rear side block.

4. A vane compressor as claimed in claim 1, further including at least two communication passages formed in said front head and communicating said sealing chamber with said annular front suction chamber.

5. A vane compressor as claimed in claim 4, wherein said at least two communication passages comprises two communication passages arranged diametrically symmetrical with respect to said sealing chamber.

* * * * *

UNITED STATES PATENT AND TRADEMARK OFFICE

CERTIFICATE OF CORRECTION

PATENT NO. : 4,502,854

DATED : March 5, 1985

INVENTOR(S) : Tsunenori SHIBUYA, et al

It is certified that error appears in the above-identified patent and that said Letters Patent is hereby corrected as shown below:

COLUMN 2, line 42, change "FIG. 1" to --FIG. 1A--.

Signed and Sealed this

*Twentieth* Day of *August 1985*

[SEAL]

*Attest:*

DONALD J. QUIGG

*Attesting Officer* *Acting Commissioner of Patents and Trademarks*